US007185692B2

(12) United States Patent
Nien et al.

(10) Patent No.: US 7,185,692 B2
(45) Date of Patent: Mar. 6, 2007

(54) FABRIC BLIND SLAT FOR WINDOW BLIND

(75) Inventors: Ming Nien, Changhua Hsien (TW); Hermes Huang, Chang-Hwa Hsien (TW)

(73) Assignees: Nien Made Enterprise Co., Ltd., Taichung (TW); Yuan Peing Garment Co., Ltd., Chang-Hwa Hsien ( * ) Notice: Subject to any disclaimer, the term of this patent is extended or adjusted under 35 U.S.C. 154(b) by 303 days.

(21) Appl. No.: 10/857,853

(22) Filed: Jun. 2, 2004

(65) Prior Publication Data

US 2005/0155726 A1 Jul. 21, 2005

(30) Foreign Application Priority Data

Jan. 20, 2004 (TW) ..... 93201237 U

(51) Int. Cl.
*E06B 9/00* (2006.01)

(52) U.S. Cl. ..... 160/236; 160/236; 160/130

(58) Field of Classification Search ..... 160/84.04, 160/84.05, 168.1 R, 176.1 R, 178.1 R, 237, 160/236, DIG. 7, 89, 130, 173 R
See application file for complete search history.

(56) References Cited

U.S. PATENT DOCUMENTS 372,621 A * 11/1887 Zorbas ..... 72/200
497,276 A * 5/1893 Tyner ..... 431/299
1,789,655 A * 1/1931 Iwata ..... 160/173 R
3,999,590 A * 12/1976 Koch ..... 160/84.01
4,550,038 A * 10/1985 Becker et al. ..... 428/12
4,951,729 A * 8/1990 Chi Yu ..... 160/178.3
5,219,407 A * 6/1993 Herring Lloyd W. ..... 160/330
5,664,613 A * 9/1997 Jelic ..... 160/84.05
5,829,506 A * 11/1998 Zorbas ..... 160/236
5,845,690 A * 12/1998 Colson et al. ..... 160/84.01
5,957,183 A * 9/1999 Prince ..... 160/168.1 R
6,318,441 B1 * 11/2001 Love et al. ..... 160/236
6,672,361 B2 * 1/2004 Fransen ..... 160/85
6,675,859 B2 * 1/2004 Nien ..... 160/89
6,688,370 B1 * 2/2004 Nien ..... 160/121.1
6,688,373 B2 * 2/2004 Corey et al. ..... 160/236
6,691,761 B1 * 2/2004 Alkhoury et al. ..... 160/273.1
6,834,702 B2 * 12/2004 Nien ..... 160/178.1 R
6,854,504 B2 * 2/2005 Nien ..... 160/176.1 R

* cited by examiner

*Primary Examiner*—Hugh B. Thompson, II
*Assistant Examiner*—Candace L. Bradford
(74) *Attorney, Agent, or Firm*—Bacon & Thomas, PLLC

(57) ABSTRACT

A fabric blind slat for a window blind includes a base fabric made from an opaque knitted fabric, two coil units respectively coupled to and extended along two opposite edges of the base fabric, and two supporting sleeves respectively enclosed inside the two coil units. The coil unit is knitted from a thread looped on a thread at the edge of the basic fabric. The supporting sleeve is a tubular member having two open ends for insertion of a rigid supporting member therein. The supporting sleeve is enclosed inside the coil unit at the time while the coil unit is formed by knitting.

21 Claims, 5 Drawing Sheets

FABRIC BLIND SLAT FOR WINDOW BLIND

BACKGROUND OF THE INVENTION

1. Field of the Invention

The present invention relates to a window blind and more particularly, to a fabric blind slat for the window blind.

2. Description of the Related Art

Various blinds for covering windows are known. These window blinds include Venetian blinds, pleated blinds, roller shades, Roman shades, honeycomb shades, etc. Conventionally, a window blind may be comprised of a plurality of separated blind slats that can be tilted to regulate the light, or a series of blind slats that can be lifted/lowered to regulate the light. These window blinds commonly use blind slats to control shading of incident light.

Currently, wood, plastic, metal and compound materials are commonly used to make blind slats. Material selection is determined subject to many factors including light transmitting rate, durability, weight, and price. Fabric materials may be used for making blind slats for a window blind for the advantage of their aesthetic appearance. However, fabric blind slats have the drawback of easy to sag. In order to eliminate sagging of fabric blind slats, U.S. Pat. No. 5,829,506 discloses a fabric blind slat, which comprises an elongated strip of fabric characterized in that the strip of fabric has at least one longitudinally extending pocket on a longitudinal edge into which a relatively rigid support member is insertable. The longitudinal extending pocket is integrally formed with the strip and, in cross section, has a seamless endless periphery. According to this design, the pocket must be stiff so as to define a longitudinal extending space for the insertion of the rigid support member. (According to experience, if the pocket is made soft, the insertion of the rigid rod member into the pocket will be difficult and complicated such that the manufacturing cost will be relatively increased). To have this stiff fabric property, the pocket must be made by shuttle weaving. Because the pocket and the elongated strip of fabric are made in integrity, the elongated strip of fabric must be shuttle-weaving fabric. Shuttle-weaving fabric has a high density, however it is easy to wrinkle. Due to poor wrinkle-resistant material property, the aforesaid fabric blind slat starts to wrinkle quickly with use or after washing. When the fabric blind slat wrinkled, the sense of beauty of the fabric material is destroyed. The wrinkles of the fabric blind slat affect passing of incident light into the inside of the house. Further, shuttle-weaving fabric has low tear-resistance. When washed with force, the fabric blind slat may be torn easily. When damaged, the fabric blind slat must be replaced, causing inconvenience.

SUMMARY OF THE INVENTION

It is the primary objective of the present invention to provide a fabric blind slat for window blind, which not only has a stiff longitudinal pocket for insertion of a rigid member but also can be kept in shape against wrinkling.

It is another objective of the present invention to provide a fabric blind slat for window blind, which has a relatively higher tear-resistance.

It is still another objective of the present invention to provide a fabric blind slat for window blind, which prevents dazzling of incident light.

It is still another objective of the present invention to provide a fabric blind slat for window blind, which has an aesthetic appearance to causes a sense of beauty.

To achieve these objectives of the present invention, the fabric blind slat for a window blind provided by the present invention comprises a base fabric made from an opaque knitted fabric, two coil units coupled to and extended along two opposite edges of the base fabric, and two supporting sleeves respectively enclosed inside the two coil units. The coil unit is knitted from a thread looped on a thread at the edge of the basic fabric. The supporting sleeve is a tubular member having two open ends for insertion of a rigid supporting member. The supporting sleeve has a hardness greater than that of the coil unit. The supporting sleeve is enclosed inside the coil unit at the time while the coil unit is formed by knitting.

DETAILED DESCRIPTION OF THE INVENTION

Figure 1:
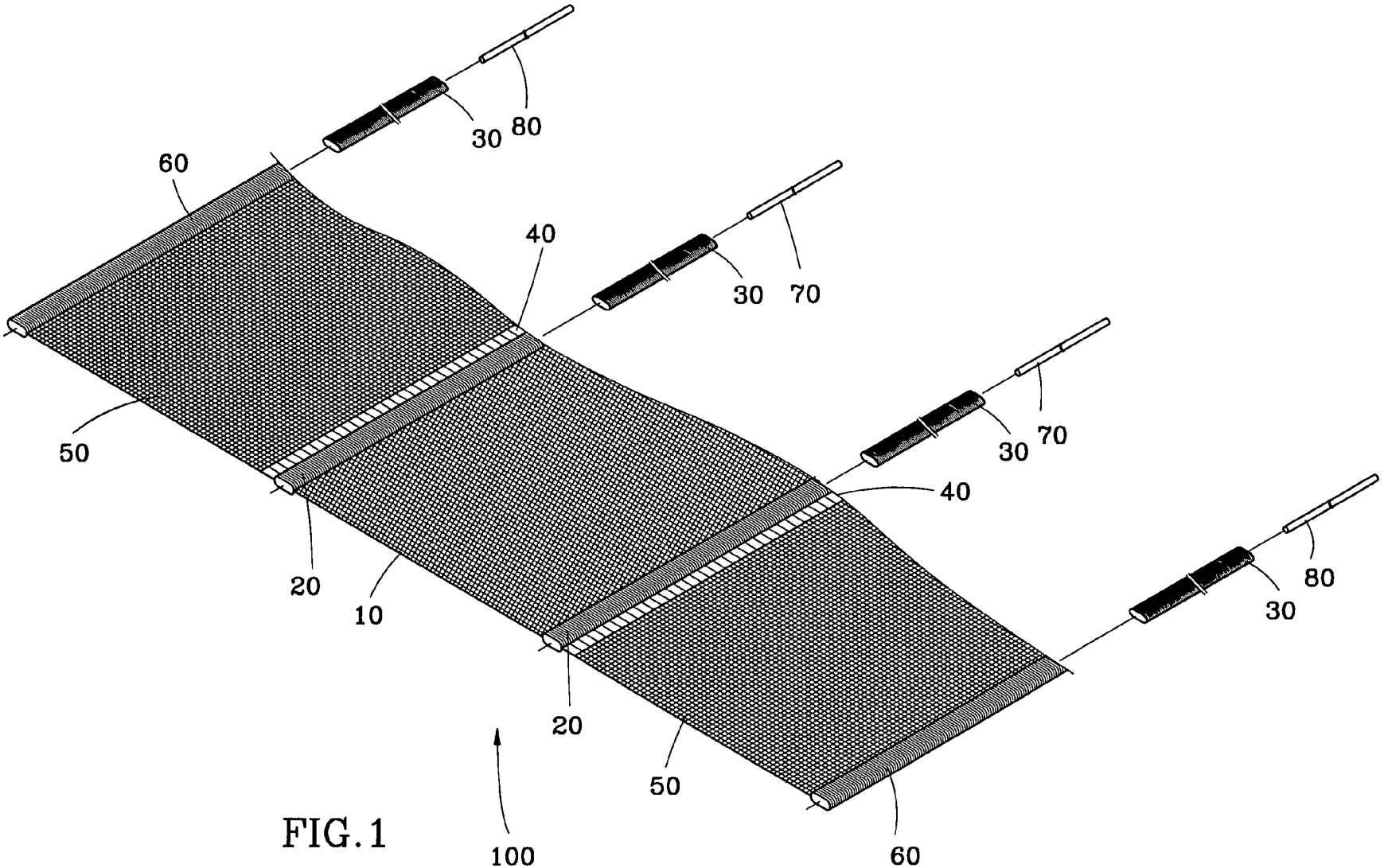
FIG. 1 is an exploded view of a preferred embodiment of the present invention.

Referring to FIGS. 1–6, a fabric blind slat 100 is shown for use in a window blind, for example, a Venetian blind. The fabric blind slat 100 is preferably integrally made by a knitting machine such that the fabric blind slat 100 can has the advantage of high wrinkle-resistance and tear-resistance power. As shown in FIG. 1, the fabric blind slat 100 comprises a base fabric 10, two longitudinal extending inner coil units 20, four supporting sleeves 30, two folding segments 40, two shading segments 50, two longitudinal extending outer coil units 60, two supporting members 70, and two weights 80.

The base fabric 10 is a narrow, elongated, thin opaque sheet member of knitted fabric, having two end-edge threads 111 respectively extended along the two opposite long edges. The end-edge thread 111 can be arranged in a respective straight line as shown in FIG. 2, or can be arranged as curved loop-like line as shown in FIG. 3.

Figure 2:
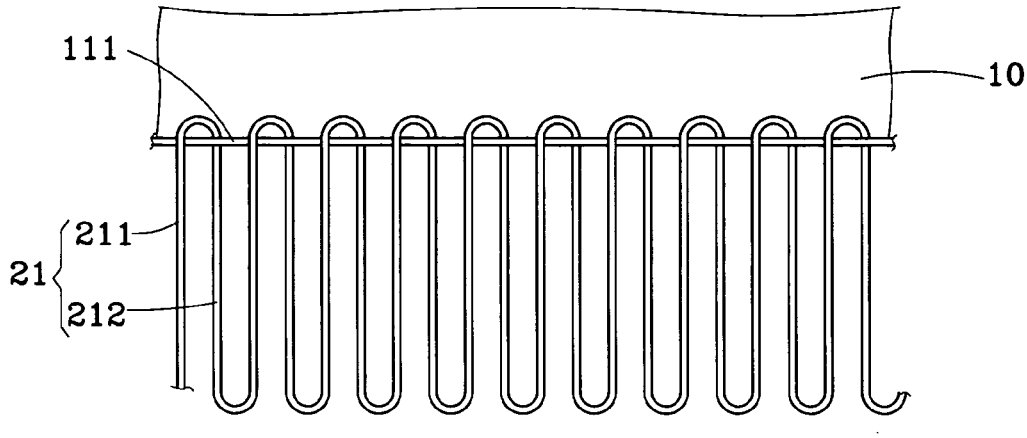
FIG. 2 is a schematic view of a part of FIG. 1, showing one knitting pattern of the coil unit where a thread is looped on a straight thread at an edge of the base fabric.
Figure 3:
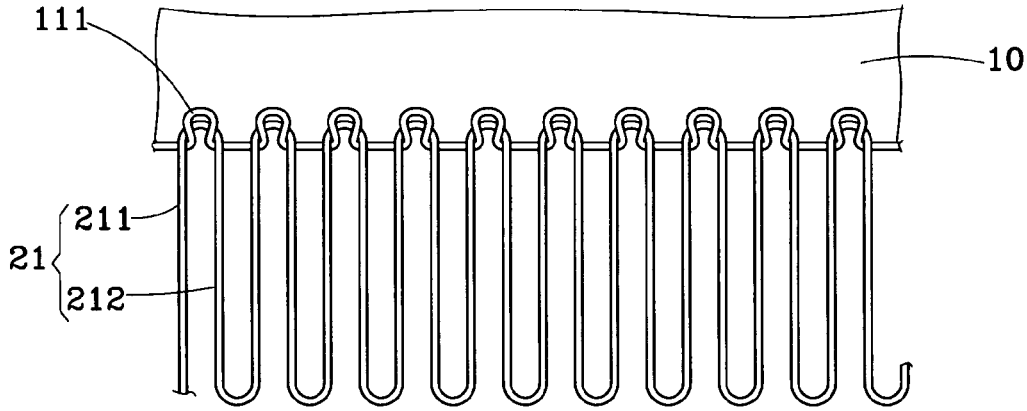
FIG. 3 is similar to FIG. 2 but showing another knitting pattern of the coil unit where a thread is looped on a loop-like thread at an edge of the base fabric.
Figure 4:
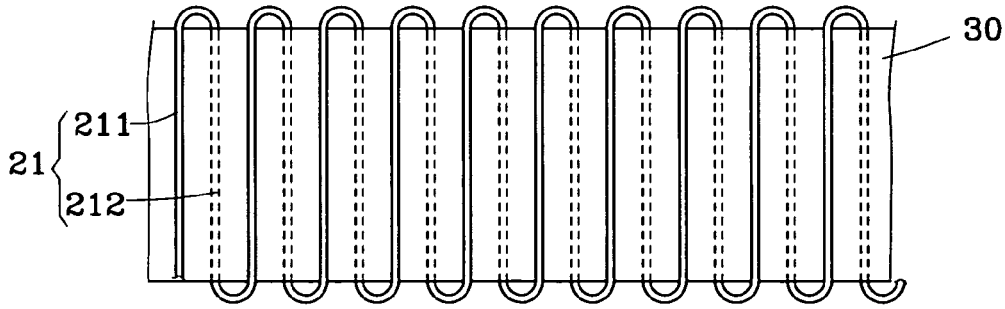
FIG. 4 is a schematic view of the preferred embodiment of the present invention, showing the coil unit knitted around the supporting sleeve.

As shown in FIGS. 2 and 3, the inner coil unit 20 is coupled to and extended along the end-edge thread 111 of the base fabric 10. The inner coil unit 20 comprises a thread 21 wound round and extended along the end-edge thread 111. In FIG. 2, one odd-numbered portion 211 of the loop-like thread 21 is extended over the end-edge thread 111 and then turned downwards to a predetermined distance to form an even-numbered portion 212, and then the even-numbered portion 212 is turned upwards toward the end-edge thread 111 to form another odd-numbered portion, and the winding procedure is repeated again and again to form the desired inner coil unit 20 at the end-edge thread 111 of the base fabric 10. In FIG. 3, one odd-numbered portion 211 of the thread 21 is extended upward to the left side of one loop of the end-edge thread 111 and then turned across the right side of the loop and extended downwards to a predetermined distance to form an even-numbered portion 212, and the winding procedure is repeated again and again to form the desired inner coil unit 20 at the end-edge thread 111 of the base fabric 10. Either the pattern shown in FIG. 2 or the pattern shown in FIG. 3, the odd-numbered portions 211 and even-numbered portions 212 of each thread 21 are stretched outwards in reversed directions, thereby providing a tubular passage for insertion of one supporting sleeve 30.

The supporting sleeves 30 are tubular cloth members of relatively harder material having two ends opened and a relatively higher density than the base fabric 10 and the inner coil units 20. The supporting sleeves 30 are put in the knitting machine before knitting the inner coil units 20 so that the inner coil units 20 can be formed around the supporting sleeves 30 respectively (see FIG. 4), i.e., the inner coil units 20 are knitted around the respective supporting sleeves 30 each having at least one thread 21 coupled to one long side of the base fabric 10 where the odd-numbered portions 211 of the thread 21 of each inner coil unit 20 are disposed on the upper side of the respective supporting sleeve 30 and the respective even-numbered portions 211 disposed on the bottom side of the respective sleeve 30.

The two folding segments 40 are knitted fabrics of reinforced yarns, which are tough and flexible and can deform easily with external traction force, respectively outwardly extended from the respective outer lateral side of the inner coil units 20 along the length thereof.

The two shading segments 50 are meshed fabrics knitted on the outer side of each folding segment 40. The width and length of the shading segments 50 are approximately equal to the base fabric 10 in width and length. Further, the two shading segments 50 have different sizes of meshes, i.e., the two shading segments 50 have different light shading ratios.

The two outer coil units 60 are respectively knitted on the respective outer side of the shading segments 50 around the other two of the supporting sleeves 30 in a manner similar to the knitting of the inner coil units 20.

The supporting members 70 are rigid round rods approximately equal to the length of the inner coil units 20 and respectively inserted into the supporting sleeves 30 in the inner coil units 20 to support the inner coil units 20 in shape.

The weights 80 are heavy rigid round rods approximately equal to the length of the outer coil units 60 and respectively inserted into the supporting sleeves 30 in the outer coil units 60 such that the shading segments 50 and the outer coil units 60 can be smoothly saggy when the fabric blind slat 100 is in use by means of the weight 80.

Figure 5:
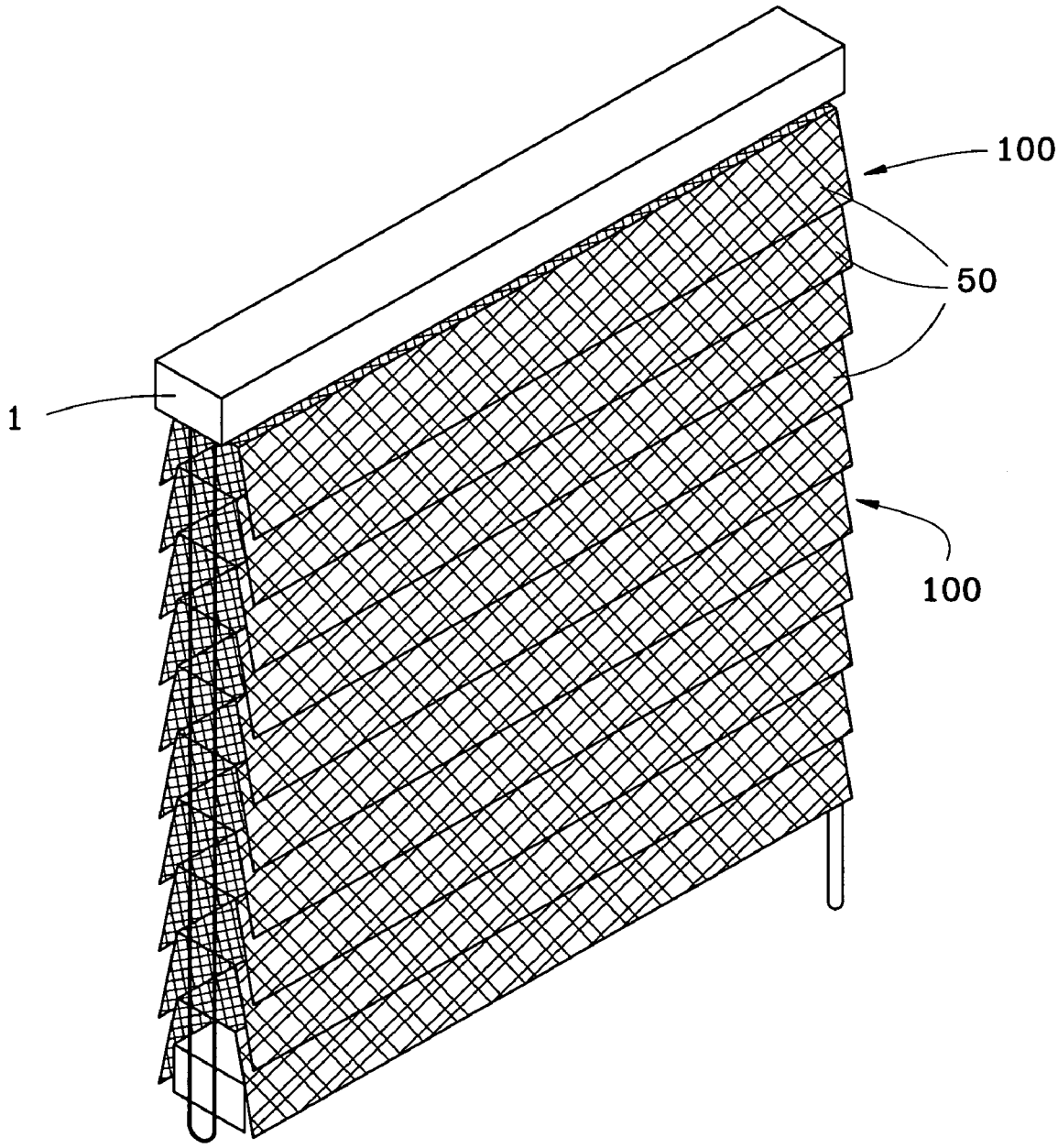
FIG. 5 is a perspective view of a Venetian blind using the fabric blind slats according to the present invention.
Figure 6:
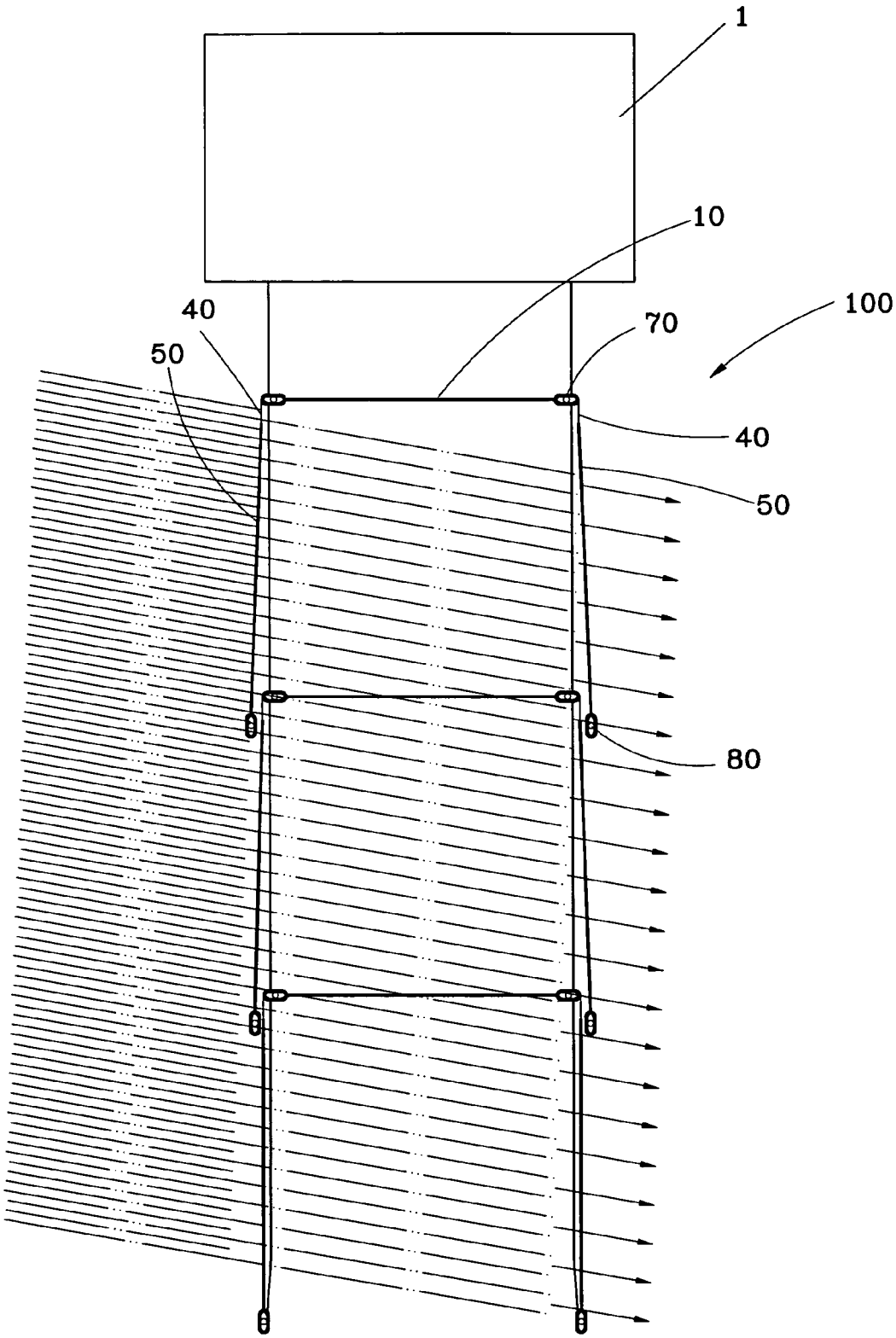
FIG. 6 is a schematic drawing showing incident light passed through the fabric blind slats from the outside of the house into the inside of the house according to the present invention.

The installation and use of the fabric blind slat 100 in a window blind are described hereinafter with reference to FIGS. 5 and 6. A predetermined number of fabric blind slats 100 are spacedly arranged in parallel below the headrail 1. Because the two long sides of the base fabric 10 is supported between the supporting members 70, the base fabric 10 is kept in a flat manner. Therefore, cord members can be suspended from the headrail 1 to join fabric blind slats 100, holding fabric blind slats 100 in parallel at different elevations. The installation procedure of fabric blind slats 100 can be referred to U.S. Pat. No. 5,829,506 or U.S. application Ser. No. 10/378829 filed by the present applicant. Because the installation procedure of fabric blind slats 100 is not within the scope of the present invention, no further detailed description in this regard is necessary. At this time, the shading segments 50 is sagging due to the effect of the weights 80 and the deformable feature of the tough flexible folding segments 40. During installation, the shading segments 50 are so arranged that the one which has relatively smaller meshes (higher light shading ratio) is disposed facing the inside of the house, and the other one which has relatively greater meshes (lower light shading ratio) is disposed facing the outside of the house. After the base fabric 10 has been set in a flat manner, incident light passes from the outdoor through the shading segment 50, which has relatively greater meshes, and then through the shading segment 50, which has relatively smaller meshes, and then into the inside of the house, and therefore light rays entered the house does not dazzle the eyes.

Because the fabric blind slat 100 is a knitted fabric, it has a good wrinkle-resistance feature. When washed with water, the fabric blind slat 100 won't be wrinkled easily. Because the knitted fabric of the fabric blind slat 100 has high tear-resistance strength, the fabric blind slat 100 is durable in use. Because inner coil units 20 and the outer coil units 60 are knitted fabrics having a bulky structure, it is not easy to directly insert the supporting members 70 and the weights 80 into the inner coil units 20 and the outer coil units 60. Therefore, the sleeves 30 are preset in the inner coil units 20 and the outer coil units 60 to accommodate the support members 70 and the weights 80.

Further, because the two folding segments 40 are knitted fabrics of reinforced yarns respectively outwardly extended from the respective outer side of the inner coil units 20, the folding segments 40 are curved smoothly to keep the base fabric 10 and the shading segments 50 in flat when the weights 80 pulling the shading segments 50 downwards.

Figure 7:
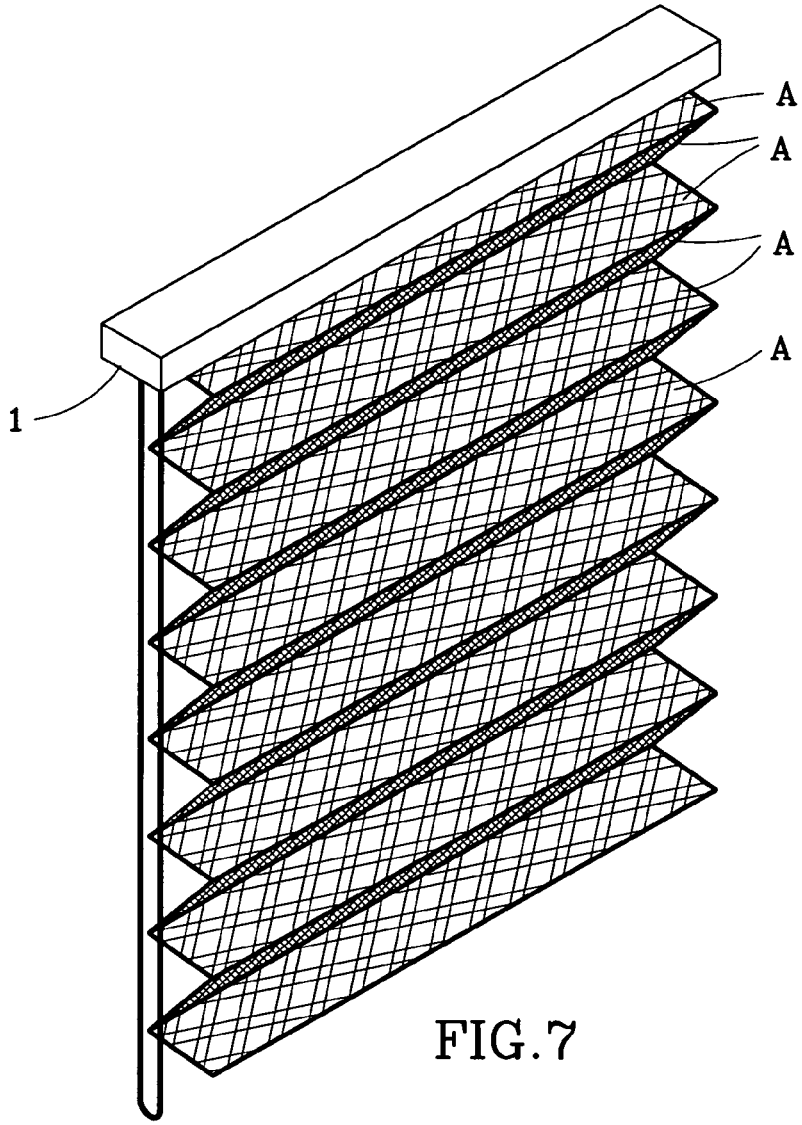
FIG. 7 is a perspective view of a pleated window shade using the fabric blind slats according to another preferred embodiment of the present invention.
Figure 8:
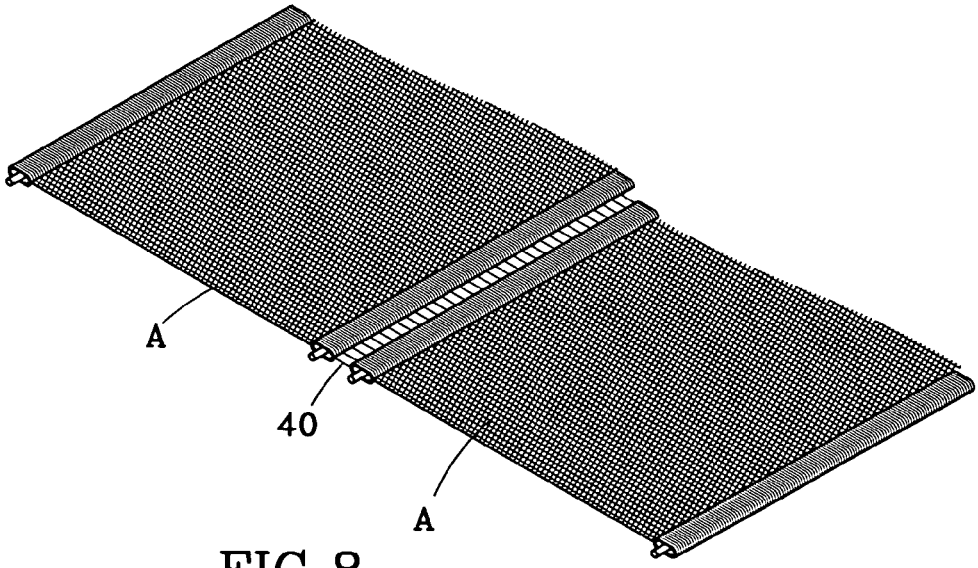
FIG. 8 is a perspective view of the fabric blind slat used in FIG. 7.

Actually, the main feature of the present invention is at the linking between the base fabric 10 and the coil units 20 and the attachment of the supporting members 70 to form a fabric slat, achieving the effect of the present invention. The folding segments 40, the shading segments 50, the outer coil units 60, the supporting members 70, and the weights 80 illustrated in the above-mentioned embodiment just show the use of the present invention in a Venetian blind. As shown in FIG. 7, the invention can also be employed to a pleated shade. As shown in FIG. 8, the pleated shade comprises a plurality of fabric slats A and a plurality of folding segments 40 respectively connected between each two fabric slats A. By means of the folding segments 40, the fabric slats A can be folded up or extended out relative to one another.

What is claimed is:

1. A fabric blind slat for a window blind, comprising:

A base fabric made from an opaque knitted fabric and having two opposite edges;

two inner coil units respectively coupled to and extended along the two opposite edges of said base fabric, said inner coil units each having at least one thread knitted on a respective end-edge thread at each of said edge of said base fabric;

two supporting sleeves respectively enclosed in said coil units, said supporting sleeves being tubular members having two open ends; and two supporting members respectively formed of a relatively rigid rod member and respectively received in said supporting sleeves;

wherein said at least one thread of each said inner coil unit has odd-numbered portions and even-numbered portions which are stretched in reversed directions for the insertion for the supporting sleeve.

2. The fabric blind slat for a window blind as claimed in claim 1, wherein said supporting sleeves are harder than said inner coil units and have a higher density than that of said coil units.

3. The fabric blind slat for a window blind as claimed in claim 1, wherein said at least one thread of each said inner coil unit has odd-numbered portions and even-numbered portions respectively would round upper and bottom sides of the respective supporting sleeve.

4. The fabric blind slat for a window blind as claimed in claim 1, further comprising a folding segment outwardly extended from an outer side of one said inner coil unit, and a meshed shading segment outwardly extended from an outer side of said folding segment opposite to said inner coil units.

5. The fabric blind slat for a window blind as claimed in claim 1, further comprising a meshed shading segment outwardly extended from an outer side of one said inner coil unit.

6. The fabric blind slat for a window blind as claimed in claim 1, further comprising two folding segments made from a tough and flexible material and respectively outwardly extended from an outer side of each of said inner coil units, and two meshed shading segments respectively outwardly extended from an outer side of each of said folding segments.

7. The fabric blind slat for a window blind as claimed in claim 6, wherein said meshed shading segments have different sizes of meshes.

8. A fabric blind slat for a window blind, comprising:

a base fabric made from an opaque knitted fabric and having two opposite edges;

two inner coil units respectively coupled to and extended along the two opposite edges of said base fabric, said inner coil units each having at least one thread knitted on a respective end-edge thread at each of said edge of said base fabric;

two supporting sleeves respectively enclosed in said coil units, said supporting sleeves being tubular members having two open ends;

two supporting members respectively formed of a relatively rigid rod member and respectively received in said supporting sleeves;

a folding segment outwardly extended from an outer side of one said inner coil unit, and a meshed shading segment outwardly extended from an outer side of said folding segment opposite to said inner coil units; and an outer coil unit having at least one thread knitted on an outer side of said shading segment, a supporting sleeve being a tubular member having two open ends and enclosed in said outer coil unit, and a weight received in said supporting sleeve inside said outer coil unit.

9. A fabric blind slat for a window blind, comprising:

a base fabric made from an opaque knitted fabric and having two opposite edges;

a coil unit coupled to and extended along one of said edges of said base fabric, said coil unit having at least one thread knitted on an end-edge thread at said edge of said base fabric;

a supporting sleeve enclosed in said coil unit, said supporting sleeve being a tubular member having two open ends; and a supporting member formed of a relatively rigid rod member and received in said supporting sleeve.

10. A window blind, comprising:

a headrail; and a plurality of fabric slats joined by cord members and spacedly arranged below said headrail, said fabric slats each comprising:

a base fabric made from an opaque knitted fabric and having two opposite edges;

two inner coil units respectively coupled to and extended along the two opposite edges of said base fabric, said inner coil units each having at least one thread knitted on a respective end-edge thread at each of said edges of said base fabric;

two supporting sleeves respectively enclosed in said coil units, said supporting sleeves being tubular members having two open ends; and two supporting members respectively formed of relatively rigid rod member and respectively received in said supporting sleeves;

wherein said at least one thread of each said inner coil unit has odd-numbered portions and even-numbered portions respectively wound round upper and bottom sides of the respective supporting sleeve.

11. The window blind as claimed in claim 10, wherein supporting sleeves are harder than said inner coil units and have a higher density than that of said coil units.

12. The window blind as claimed in claim 10, wherein said fabric slats each further comprise a folding segment outwardly extended from an outer side of one said inner coil unit, and a meshed shading segment outwardly extended from an outer side of said folding segment opposite to said inner coil units.

13. The window blind as claimed in claim 10, wherein said fabric slats each further comprise two folding segments made from a tough and flexible material and respectively outwardly extended from an outer side of each of said inner coil units, and two meshed shading segments respectively outwardly extended from an outer side of each of said folding segments.

14. The window blind as claimed in claim 13, wherein said meshed shading segments have different sizes of meshes.

15. A window blind, comprising:

a headrail: and a plurality of fabric slats joined by cord members and spacedly arranged below said headrail, said fabric slats each comprising:

a base fabric made from an opaque knitted fabric and having two opposite edges;

two inner coil units respectively coupled to and extended along the two opposite edges of said base fabric, said inner coil units each having at least one thread knitted on a respective end-edge thread at each of said edges of said base fabric;

two supporting sleeves respectively enclosed in said coil units, said supporting sleeves being tubular members having two open ends; and two supporting members respectively formed of relatively rigid rod member and respectively received in said supporting sleeves;

wherein said at least one thread of each said inner coil unit has odd-numbered portions and even-numbered portions, which are stretched in reversed directions for the insertion of the supporting sleeve.

16. A window blind, comprising:

a headrail; and a plurality of fabric slats joined by cord members and spacedly arranged below said headrail, said fabric slats each comprising:

a base fabric made from an opaque knitted fabric and having two opposite edges;

two inner coil units respectively coupled to and extended along the two opposite edges of said base fabric, said inner coil units each having at least one thread knitted on a respective end-edge thread at each of said edges of said base fabric;

two supporting sleeves respectively enclosed in said coil units, said supporting sleeves being tubular members having two open ends; and two supporting members respectively formed of a relatively rigid rod member and respectively received in said supporting sleeves;

wherein said fabric slats each further comprise a folding segment outwardly extended from an outer side of one said inner coil unit, and a meshed shading segment outwardly extended from an outer side of said folding segment opposite to said inner coil units;

wherein said fabric slats each further comprise an outer coil unit having at least one thread knitted on an outer side of said shading segment, a supporting sleeve being a tubular member having two open ends and enclosed in said outer coil unit, and a weight received in said supporting sleeve inside said outer coil unit.

17. A fabric blind slat for a widow blind, comprising a base fabric, which is made from an opaque fabric and has two opposite edges and a coil unit knitted from at least one thread looped at one of said edges, a supporting sleeve, which is a tubular member having two open ends, enclosed in said coil unit, and a supporting member formed of a rigid rod member and received in said supporting sleeve; wherein said supporting sleeve is harder than said inner coil unit and has a higher density than that of said coil unit.

18. The fabric blind slat for a window blind as claimed in claim 17, wherein the thread has odd-numbered looped portions and even-numbered looped portions respectively wound round upper and bottom sides of the supporting sleeve.

19. The fabric blind slat for a window blind as claimed in claim 17, wherein the thread has odd-numbered looped portions and even-numbered looped portions, which are stretched in reversed directions for enclosing the supporting sleeve.

20. The fabric blind slat for a window blind as claimed in claim 17, further comprising a folding segment outwardly extended from an outer side of said coil unit, and a meshed shading segment outwardly extended from an outer side of said folding segment.

21. The fabric blind slat for a window blind as claimed in claim 20, further comprising a coil knit knitted from at least one thread looped on an outer side of said shading segment, said coil unit enclosing therein a supporting sleeve which is a tubular member having two open ends, and a weight received in said supporting sleeve inside said coil unit.

* * * * *